United States Patent [19]

Edmonston

[11] Patent Number: 4,926,059

[45] Date of Patent: May 15, 1990

[54] CARBURETOR

[76] Inventor: William H. Edmonston, 22264 Ottawa Rd., Unit 10, Apple Valley, Calif. 92308

[21] Appl. No.: 378,761

[22] Filed: Jul. 12, 1989

[51] Int. Cl.[5] ..... F02M 9/06

[52] U.S. Cl. ..... 261/44.3; 261/DIG. 38

[58] Field of Search ..... 261/44.3, DIG. 38

[56] References Cited

U.S. PATENT DOCUMENTS

| | | | |
|---|---|---|---|
| 2,987,304 | 6/1961 | Roy | 261/44.3 |
| 4,013,741 | 3/1977 | Edmonston | 261/44.3 |
| 4,097,562 | 6/1978 | Blakeway | 261/44.3 |
| 4,123,479 | 10/1978 | Andreassen | 261/44.3 |
| 4,221,747 | 9/1980 | Edmonston | 261/44.3 |
| 4,442,046 | 4/1984 | Edmonston | 261/44.3 |

*Primary Examiner*—Tim Miles

*Attorney, Agent, or Firm*—Frank P. Presta

[57] ABSTRACT

The position of the metering rod relative to the slide member of a carburetor is adjusted by rotation of an adjusting screw which slidably extends through an opening in a plate member fixedly mounted within a substantially vertical bore in the slide member. The upper end of the adjusting screw has an enlarged head in engagement with the upper surface of the plate member and is engageable with a suitable tool to rotate the adjusting screw. The lower end of the adjusting screw is threadably received within a threaded bore in the head portion of the metering rod which is slidably and nonrotatably received within the bore in the slide member. A helical spring member surrounds the adjusting screw and is disposed between the lower surface of the plate member and the head portion of the metering rod to urge the metering rod downwardly. Accordingly, rotation of the adjusting screw causes the metering rod to move upwardly or downwardly so as to vertically adjust it relative to the slide member.

7 Claims, 2 Drawing Sheets

CARBURETOR

BACKGROUND OF THE INVENTION

The present invention relates to a carburetor construction and, more particularly, to a new and improved apparatus for adjusting the position of the fuel metering rod in a carburetor of the type disclosed in my U.S. Pat. No. 4,442,046, the disclosure of which is incorporated herein by reference.

Although previously used and disclosed carburetors of the slide and metering rod type have generally served the purpose, they have been so constructed as to make it difficult to mount and adjust the fuel metering rod accurately relative to the slide. In some cases the adjustment apparatus has been complicated and thus difficult and expensive to manufacture and/or assemble.

Accordingly, a need has arisen for a simple and reliable construction for enabling a fuel metering rod in such a carburetor to be adjusted easily and accurately on the slide member.

SUMMARY OF THE INVENTION

In the carburetor of the present invention, the position of the metering rod relative to the slide member can be easily adjusted by rotation of an adjusting screw which can be engaged through an opening in the upper portion of the carburetor housing in alignment therewith. The adjusting screw slidably extends through an opening in a plate member fixedly mounted within a substantially vertical bore in the slide member. The upper end of the adjusting screw is provided with an enlarged head that is in engagement with the upper surface of the plate member. The enlarged head has a recess or the like in its upper end for receiving the end of an Allen wrench, screwdriver or the like to rotate the adjusting screw.

The lower end of the adjusting screw is threadably received within a threaded bore in the head portion of the metering rod. The head portion of the metering rod is slidably received within the bore in the slide member and is of a size and cross sectional shape that is complementary to that of the bore so as to be nonrotatable therein. A helical spring member surrounds the adjusting screw and is disposed between the lower surface of the plate member and the head portion of the metering rod to urge the metering rod downwardly to a desired idle position or the like relative to the slide member. In this manner, rotation of the adjusting screw in the threaded bore of the metering rod causes it to move upwardly or downwardly in the bore of the slide member so as to vertically adjust the metering rod relative to the slide member to adjust idle or mid-range operation of the carburetor.

DESCRIPTION OF THE PREFERRED EMBODIMENT

Figure 1:
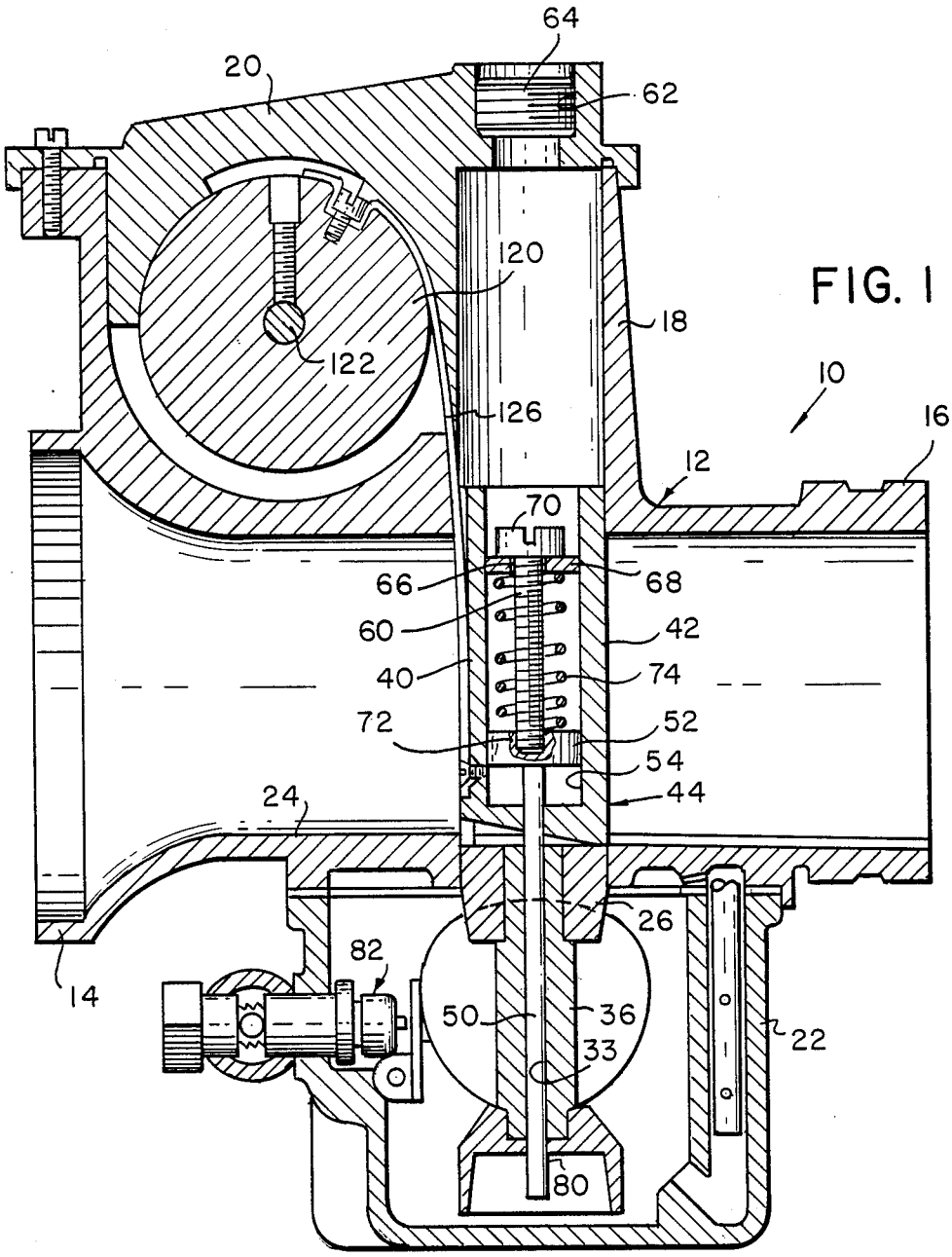
FIG. 1 is a side elevational view in section of a carburetor constructed in accordance with the principles of the present invention.

Referring to FIG. 1, the carburetor 10 of the present invention generally comprises a body 12 having an air inlet end 14, an air outlet end 16 and a centrally located slide supporting portion 18; a cover 20 adapted to fit over the upper portion of the slide supporting portion 18; and a fuel reservoir or bowl 22 is secured to the underside of the body beneath the slide supporting portion. Preferably, the inlet end 14, outlet end 16 and slide supporting portion 18 are formed of unitary construction and a throat 24 extends through the body from one end to the other. The cover 20 and reservoir 22 may be removably secured to the body 12 in any suitable manner.

Figure 3:
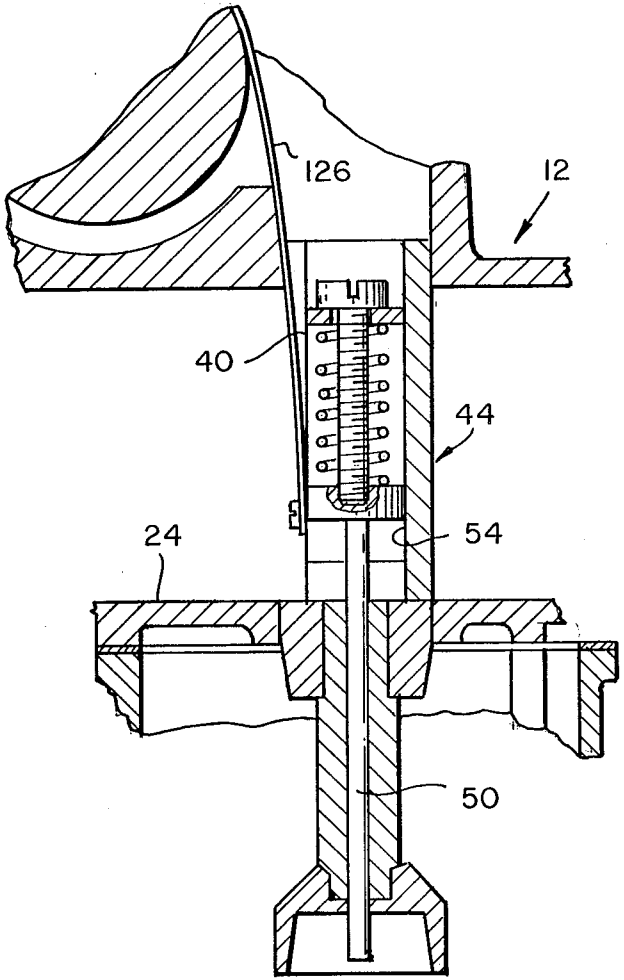
FIG. 3 is a front elevational view of the slide member of the second embodiment shown in FIG. 2.

The disclosures of my U.S. Pat. Nos. 4,221,747 and 4,442,046 are incorporated herein by reference. As shown in FIGS. 3, 4 and 6 of U.S. Pat. No. 4,221,747, the body 12 is provided with an insert 26 fixedly mounted in any suitable manner within the slide supporting portion 18. The insert 26 comprises an upper portion having an aperture therethrough that corresponds in size and shape to the adjacent portions of the throat 24 in the body 12. The upper end of the upper insert portion is open and comprises oblique end faces (not shown), one of which may have a threaded aperture (not shown) extending therethrough which is adapted to receive an idle stop screw (not shown) which serves to control the idle position of the throttle slide member 44 in a manner to be described hereinafter. A fuel supply tube 36 is secured to the bottom of the upper portion 28 and extends through an aperture therein into communication with the aperture 30. The fuel supply tube 36 extends downwardly into the fuel reservoir or bowl 22 for a purpose to be more fully described hereinafter.

As shown in FIG. 1, the insert 26 is narrower than the adjacent portions of the slide supporting portion 18 so as to define grooves on each side of the slide supporting portion that are adapted to slidably receive the side edge portions of the front and rear panels 40 and 42 of a throttle slide member 44 mounted within the slide supporting portion 18 for substantially vertical slidable movement therein. At its upper portion, the slide member 44 is provided with a pair of downwardly facing oblique surfaces 46 (see U.S. Pat. No. 4,221,747) which are adapted to engage the complementary oblique faces 32 on the upper end of the insert 26 for the purpose of limiting the downward movement of the slide member 44 within the slide supporting portion 18 of the body 12. The idle stop screw can be adjusted to engage one of oblique surfaces (not shown) on the slide member 44 for the purpose of adjusting the lowest or idle position of the slide member. The insert 26 may be retained within the slide supporting portion 18 by a suitable means such as locking screws, locking pins or the like.

A fuel metering rod or needle 50 is adjustably secured to and extends downwardly from the slide member 44 into the central opening 33 of the fuel supply tube 36. The metering rod 50 is provided with an enlarged head portion 52 at its upper end which is slidably received within a complementary internal bore 54 within the slide member 44 for the purpose of maintaining the metering rod 50 in a desired orientation which will be more fully described hereinafter. This may be accomplished, for example, by making the head portion 52 and the bore 54 of hexagonal cross section so that the metering rod will not rotate.

In accordance with the present invention, the position of the metering rod 50 relative to the slide 44 can be easily adjusted by rotation of an adjusting screw or bolt 60 which can be engaged through an opening 62 in the upper portion of the carburetor housing portion 18 in alignment therewith. The opening 62 may be closed by a threaded plug 64 or the like. The adjusting screw 60 slidably extends through an opening 66 in a plate member 68 fixedly mounted within a substantially vertical bore 54 in the slide member 44. The upper end of the adjusting screw is provided with an enlarged head 70 that is in engagement with the upper surface of the plate member 68. The enlarged head 70 has a recess or the like in its upper end for receiving the end of an Allen wrench, screwdriver or the like, to rotate the adjusting screw.

The lower end of the adjusting screw 60 is threadably received within a threaded bore 72 in the head portion 52 of the metering rod 50. The head portion 52 of the metering rod is slidably received within the bore 54 in the slide member and is of a size and cross sectional shape that is complementary to that of the bore 54 so as to be nonrotatable therein. A helical spring member 74 surrounds the adjusting screw 60 and is disposed between the lower surface of the plate member 68 and the head portion 52 of the metering rod to urge the metering rod downwardly to a desired idle position or the like relative to the slide.

In this manner, rotation of the adjusting screw 60 in the threaded bore 72 of the metering rod causes it to move upwardly or downwardly in the bore 54 of the slide member so as to vertically adjust the metering rod relative to the slide member to thereby adjust idle or mid-range operation of the carburetor.

Preferably, vertical movement of the slide member 44 is controlled by a rotary actuating member or wheel 120 that is disposed within the upper portion of the carburetor body 12 and is secured to a rod or axle 122 that is rotatably mounted on the carburetor body 12. As shown in FIG. 1 of U.S. Pat. No. 4,442,046, a second wheel or pulley 124 is secured to the outer end of the axle 122. One end of a control cable 70 is secured to the pulley 124 and the other end of the cable 70 is connected to any suitable type of manual control means (not shown) disposed on the vehicle in which the carburetor 10 is mounted. It will be readily seen, therefore, that movement of the control cable 70 results in rotation of the pulley 124, the axle 122 and the rotary actuating member or wheel 120.

An elongated flexible connecting strip 126, preferably formed of metal or another suitable material and having a concave or curved cross section, surrounds the wheel 120 and is connected at one end to the wheel 120 by suitable means such as screws. The other end of the connecting strip 126 is secured to the front panel 40 of the throttle slide member 44 by suitable means such as screws and is positioned in a recessed portion so as to be flush with the front panel 40. In this manner, rotation of the wheel 120 results in sliding movement of the slide member 44 within the slide supporting portion 18. The position of the slide member 44 in the carburetor 10, therefore, is controlled by the cable 70 through the pulley 124, axle 122, wheel 120 and connecting strip 126. The helical spring 74, which urges the slide member 44 to the closed or down position, surrounds the axle 122 and has its ends in engagement with stops 76 and 77 or the like on the supporting portion 18 and the pulley 124, respectively, as shown in FIG. 1 of U.S. Pat. No. 4,442,747. This rotary actuating assembly for the slide member 44 provides a positive and reliable push-pull arrangement for opening and closing of the slide member and enables it to be accurately positioned where desired with respect to the throat 24 of the carburetor, even if the biasing spring 74 were to break.

Within the scope of the present invention, the rotary actuating member or wheel 120 may be connected to the throttle slide member 44 by a flexible cable connection, by a rack and pinion connection or by another suitable type of connection.

The vertical position of the metering rod or needle 50 relative to the slide member 44 may be easily adjusted by rotation of the adjusting screw 60 which is provided at its upper end with a transverse recess or the like for receiving the head of a screwdriver or similar tool. Rotation of the adjusting screw 60 serves to move the head portion 52 of the metering rod 50 upwardly or downwardly within the lower portion of the bore 54 in the throttle slide member 44 to control idle or mid-range operation of the carburetor.

In one embodiment of the present invention, the metering rod or needle 50 is provided with a downwardly and inwardly tapered flat portion 80 extending from the upper portion to the lower end thereof. The enlarged head portion 52 of the metering rod 50 is so located in the bore 54 that the flat portion 80 faces the outlet end 16 of the carburetor body 12 when the metering rod 50 is mounted within the throttle slide member 44. It will be readily seen, therefore, that upward movement of the slide member 44 and corresponding upward movement of the metering rod 50 within the fuel supply tube 36 will cause a gradually larger opening at the outlet of the fuel supply tube for the supply of fuel from the fuel reservoir or bowl 22 to the carburetor throat 24, owing to the tapered flat portion 80 on the metering rod. By varying the taper of the flat portion 80 on the metering rod 50, the amount of fuel flow for a given upward movement of the slide member 44 and metering rod 50 may be adjusted.

A Venturi effect is created when air flows through the carburetor throat from the inlet to the outlet end. This airflow past the metering rod 50 and outlet end of the fuel supply tube 36 serves to create a vacuum at the outlet of the fuel supply tube, thereby causing a flow of fuel from the fuel reservoir or bowl upwardly through the opening 33 in the fuel supply tube defined by the metering rod 50 and into the carburetor throat 24 where the fuel is mixed with incoming air and moves toward the outlet end therewith. The fuel flows upwardly from the fuel reservoir 22 into the fuel supply tube 36 because the reservoir 22 is sealed and pressurized by air entering an air inlet opening 141 in the throat near the inlet end 14 and flowing through an air channel 143 into the fuel reservoir 22.

The fuel reservoir bowl 22 is provided with a suitable float valve assembly 82 or any other suitable means for maintaining a minimum quantity of fuel in the reservoir. The float valve assembly 82 is connected to a fuel supply tube (not shown) in any suitable manner.

It will be appreciated that upward and downward movement of the throttle slide member 44, as actuated in a push-pull manner by the control cable 70 and rotary actuator member 120, serves to control the air flow from the inlet end 14 to the outlet end 16 of the carburetor body 12 and also serves to control the flow of fuel from the fuel reservoir or bowl 22 to the carburetor throat 24 because of corresponding upward or downward movement of the metering rod 50 secured to the throttle slide member 44.

Figure 2:
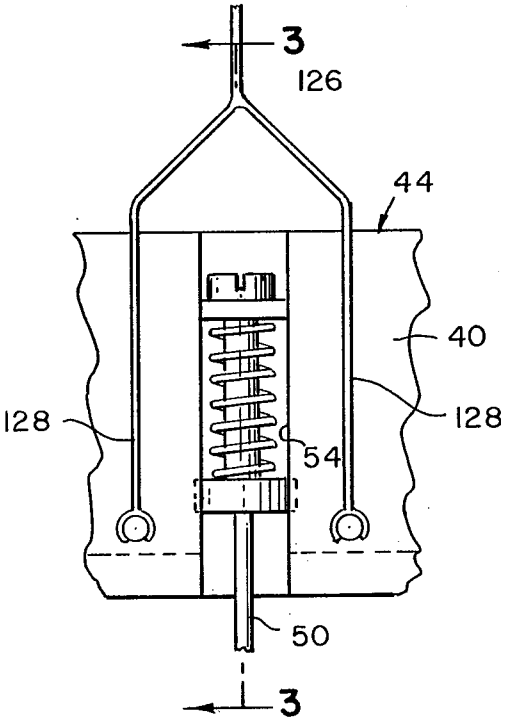
FIG. 2 is a partial side elevational view like FIG. 1, showing a second embodiment of the carburetor of the present invention.

In accordance with a second embodiment of the invention shown in FIGS. 2 and 3, the vertical bore 54 in the slide member 44 is located at the front or inlet panel 40 thereof. In this manner, the adjusting assembly for the metering rod 50 is accessible from the inlet side of the slide member. Also, for certain applications, the metering rod can be located near the front or inlet panel of the slide member, in accordance with the second embodiment of the invention. In this second embodiment, the lower end 128 of the connecting strip 126 is bifurcated so as to extend on both sides of the bore 54 in the front or inlet panel 40 of the slide member, as shown in FIG. 3.

What is claimed is:

1. A carburetor, comprising:

a body having an inlet end, an outlet end, and a throat extending therethrough from said inlet end to said outlet end, a fuel supply tube secured to the underside of said body and having an outlet in communication with said throat, a throttle slide member movably mounted on the body intermediate said inlet and outlet ends thereof for substantially transverse movement across said throat to vary the unblocked portion thereof, and a metering rod secured to said throttle slide member and extending downwardly into said fuel supply tube to control the flow of fuel therethrough, said throttle slide member comprising a substantially vertical bore therethrough and means for adjusting the position of said metering rod in a substantially longitudinal direction, said metering rod comprising a head portion at the upper end thereof, said head portion being slidable and nonrotatably received within said bore, said head portion having a threaded bore in the upper end thereof, a plate member fixedly mounted within said slide member bore above said head portion, said plate member having an opening in the center portion thereof, an adjusting screw slidably extending through said plate member opening and having its lower end threadably received within said threaded bore in said head portion, said adjusting screw having a head at its upper end in engagement with the upper surface of said plate member, and spring means surrounding said adjusting screw, the upper end of said spring means being in engagement with the lower surface of said plate member and the lower end of said spring means being in engagement with the upper surface of said head portion so that said spring means urges said adjusting screw and said metering rod downwardly, whereby rotation of said adjusting screw causes sliding movement of said head portion in said slide member bore to adjust the position of said metering rod relative to said slide member.

2. The carburetor of claim 1 wherein said head of said adjusting screw has a recess in the upper surface thereof adapted to receive an adjusting tool therein.

3. The carburetor of claim 1 wherein said head portion and said bore are of complementary cross sectional size and shape.

4. The carburetor of claim 3 wherein said head portion and said bore are of hexagonal cross section.

5. The carburetor of claim 1 wherein said spring means is a helical spring.

6. The carburetor of claim 1 wherein said bore is adjacent to the inlet panel of said slide member.

7. The carburetor of claim 6 wherein said bore is open at the inlet panel of said slide member.

* * * * *